US010737159B1

(12) United States Patent
Dickerson

(10) Patent No.: US 10,737,159 B1
(45) **Date of Patent: *Aug. 11, 2020**

(54) PORTABLE SPORTS PRACTICE NET OR SPORTS GOAL

(71) Applicant: Rukket, LLC, Wilmington, DE (US)

(72) Inventor: Ryan L. Dickerson, Athens, GA (US)

(73) Assignee: Rukket, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/388,442

(22) Filed: Apr. 18, 2019

Related U.S. Application Data

(63) Continuation-in-part of application No. 15/270,090, filed on Sep. 20, 2016, now Pat. No. 10,307,651.

(60) Provisional application No. 62/222,412, filed on Sep. 23, 2015.

(51) Int. Cl.
*A63B 63/00* (2006.01)

(52) U.S. Cl.
CPC ..... *A63B 63/004* (2013.01); *A63B 2063/002* (2013.01); *A63B 2209/10* (2013.01); *A63B 2210/50* (2013.01); *A63B 2243/0025* (2013.01)

(58) Field of Classification Search
None
See application file for complete search history.

(56) References Cited

U.S. PATENT DOCUMENTS 2,331,236 A * 10/1943 Schaefer ..... A63B 63/00 473/192
2,449,708 A 9/1948 Lindsay
3,184,235 A 5/1965 Hillbrich
3,328,033 A * 6/1967 Hendry ..... A63B 63/00 473/184
3,427,026 A * 2/1969 Mahoney ..... A63B 69/0097 473/435
3,979,120 A 9/1976 Dietrich
(Continued)

FOREIGN PATENT DOCUMENTS

DE 2847701 A1 5/1980
WO 95/24948 A1 9/1995
(Continued)

OTHER PUBLICATIONS

PowerNet Golf Practice Net 10ft×7ft with Lifetime Warranty, Jul. 11, 2016 from https://www.amazonmcom/PowerNet-Golf-Practice-LIFETIME-WARRANTY, 13 pages.

*Primary Examiner* — Melba Bumgarner
*Assistant Examiner* — Amir A Klayman
(74) *Attorney, Agent, or Firm* — Rogowski Law LLC

(57) ABSTRACT

A portable sports practice net includes a frame with a base to which removable vertical poles having top side bar supports are joined holds a net to create an opening, such as a goal opening. The top side bar supports have a unique shape and extend horizontally from the top of the vertical poles in a manner that reduces the weight placed on the net fabric hung between the vertical poles. The top side bar supports also create a depth of the goal pocket without need for additional vertical posts. Each vertical post creates a pivot point at its bottom end, such that each vertical post is urged apart from the other post to create tension or leverage between the opposite top side bar supports, thus creating a net opening with a more realistic goal shape and reducing sag at the top edge.

22 Claims, 7 Drawing Sheets

(56) References Cited

U.S. PATENT DOCUMENTS 4,083,561 A 4/1978 Daffer, Jr.
4,274,632 A * 6/1981 Jacobs ..... A63B 61/02 473/492
4,702,478 A * 10/1987 Kruse ..... A63B 63/004 135/123
4,723,780 A * 2/1988 Vinzetta ..... A63B 63/00 273/407
4,750,508 A 6/1988 Tatoian
5,186,469 A * 2/1993 Terris ..... A63B 63/004 473/478
5,244,213 A 9/1993 Armell
5,246,229 A 9/1993 Carey
5,316,314 A * 5/1994 Wilson ..... A63B 63/004 273/400
5,333,856 A * 8/1994 Gery ..... A63B 63/00 473/454
5,333,860 A 8/1994 Saito et al.
5,351,948 A * 10/1994 Thomas ..... A63B 63/00 273/400
5,431,411 A 7/1995 Padilla
5,562,288 A 10/1996 Erkebaev
5,655,774 A 8/1997 Cox
5,690,339 A 11/1997 Chen
5,730,666 A 3/1998 Hudson
5,803,841 A 9/1998 Daskoski
5,810,363 A 9/1998 Saunders
5,816,956 A 10/1998 Ellis
5,820,497 A 10/1998 Pena
5,830,089 A 11/1998 Halter
5,842,939 A 12/1998 Pui et al.
5,857,928 A * 1/1999 Stewart ..... A63B 63/004 273/400
5,989,130 A 11/1999 Macaluso
6,209,878 B1 * 4/2001 Munro ..... A63B 63/004 273/400
6,210,288 B1 4/2001 Kim
6,383,096 B1 5/2002 Green
6,409,410 B1 6/2002 Huang
6,511,390 B2 1/2003 Kim
6,558,279 B1 5/2003 Goldwitz
6,629,900 B2 10/2003 Wu
6,846,253 B1 1/2005 Szwalek
6,905,418 B2 * 6/2005 Rhee ..... A63B 63/00 473/172
7,037,221 B2 5/2006 Bouffard et al.
7,244,199 B1 * 7/2007 Romano ..... A63B 71/022 273/127 R
7,744,089 B2 6/2010 Huang
8,056,572 B2 11/2011 Livacich
8,246,496 B2 8/2012 Holland et al.
8,292,300 B2 10/2012 Moore, III
8,435,142 B2 * 5/2013 Gibson ..... A63B 41/02 273/402
8,579,737 B2 11/2013 Holland et al.
9,162,127 B2 10/2015 Holland et al.
2002/0193186 A1 * 12/2002 Kim ..... A63B 71/022 473/446
2006/0226607 A1 10/2006 Chen
2007/0281805 A1 * 12/2007 Hsiao ..... A63B 63/004 473/407
2008/0015059 A1 * 1/2008 Bradnam ..... A63B 63/004 473/446
2009/0029804 A1 * 1/2009 Crawley ..... A63B 69/0097 473/432
2009/0258735 A1 10/2009 Nash
2011/0092321 A1 4/2011 Szaro
2011/0201460 A1 8/2011 Rigoli
2012/0252606 A1 10/2012 Ennis
2012/0309568 A1 12/2012 Holland
2012/0322567 A1 * 12/2012 Manieri ..... A63B 69/36 473/151
2013/0175414 A1 7/2013 Nelson et al.
2015/0057113 A1 2/2015 Phillips
2015/0148152 A1 5/2015 Holland
2015/0151179 A1 6/2015 Holland et al.
2015/0165289 A1 6/2015 Chen
2016/0023072 A1 1/2016 Holland et al.

FOREIGN PATENT DOCUMENTS

WO 2007/96435 A1 8/2007
WO 2010/03159 A1 1/2010
WO 2011/82701 A1 7/2011

* cited by examiner

PORTABLE SPORTS PRACTICE NET OR SPORTS GOAL

CROSS-REFERENCE TO RELATED APPLICATIONS

This application is a continuation-in-part of U.S. Ser. No. 15/270,090, filed Sep. 20, 2016, status pending, which was a nonprovisional utility application claiming priority under 35 USC 119 to U.S. Ser. No. 62/222,412, filed Sep. 23, 2015.

FIELD OF THE INVENTION

The field of the present invention relates to a portable sports practice net or sports goal, such as but not limited to a portable soccer goal frame for a soccer goal net with top side bar supports for a more realistic shape and less sag along the top mouth of the goal.

BACKGROUND

Current portable soccer nets support the netting using only vertical or almost vertical flexible fiberglass poles attached to a generally U- or V-shaped base support. The fiberglass poles are flexible, and do not keep the front top edge of the net pulled tightly across the span of the goal mouth, especially for soccer goals that have a width of six feet or larger. Nets with larger goal pockets generally include additional rear posts to hold up the back portion of the netting material to create a pocket.

Within the current group of portable goals available on the market today several problems exist. The first problem is the sagging of the top cross bar which is made of fabric suspended between vertical posts over the top center of the goal. The second problem is the difficulty of set up. The third problem is that the portable goals do not replicate a real soccer goal as they do not form a proper "pocket" with a depth from the goal opening without adding extra vertical posts, which increase set up time and materials used to manufacture the goal. The fourth problem is lack of stability of prior portable goal nets, which tend to have more weight to the rear of the goal frame structure and thus are susceptible to movement and overturning when balls are kicked with greater force into the goal. Accordingly, improvements to portable soccer goals continue to be sought.

SUMMARY OF INVENTION

A portable sports goal or practice net has a base having a center section, a left side section disposed at an angle to the center section, and a right side section disposed at an angle to the center section. A first socket extends upwardly from the left side section, and a second socket extends upwardly from the right side section. A first flexible pole that has a distal end and a proximal end is adapted to be removably inserted at its distal end into the first socket. A second flexible pole that has a distal end and a proximal end is adapted to be removably inserted at its distal end into the second socket.

A first horizontal bar or top side bar is adapted for removable attachment to the proximal end of the first flexible pole. The first horizontal bar has a distal end and a proximal end and defines a length, and has a top surface and a bottom surface. In one embodiment, a first knob projects upwardly from the top surface of the first horizontal bar. In a second embodiment a first knob projects outwardly, preferably from a front surface, of the first horizontal bar.

A second horizontal bar or top side bar is adapted for removable attachment to the proximal end of the second flexible pole. The second horizontal bar has a distal end and a proximal end and defines a length between its distal end and proximal end, and has a top surface and a bottom surface. In one embodiment, a second knob projects upwardly from the top surface of the second horizontal bar. In a second embodiment a first knob projects outwardly, preferably from a front surface, of the first horizontal bar.

A net is removably attached to the frame formed by the base, poles and horizontal bars. The net has a top front edge and side front edges. The net is engagable to the first horizontal bar and the second horizontal bar so as to be held in tension along its top front edge and draped from the first horizontal bar and the second horizontal bar to the base. The net has a reinforcement tape along at least its top front edge, and preferably also along its two side front edges. The reinforcement tape at the top front edge defines a pocket adapted to receive either the first knob and the second knob of the horizontal bars, or a cord or wire that extends between the first knob and the second knob of the horizontal bars.

A portable sports practice net according to another embodiment of the invention has a base having a center section, a left side section disposed at an angle to the center section, and a right side section disposed at an angle to the center section. A first socket extends upwardly from the left side section, and a second socket extends upwardly from the right side section. A first flexible pole having a distal end and a proximal end, and having an oval or semi-oval cross-section has its distal end removably inserted into the first socket. A second flexible pole having a distal end and a proximal end, and having an oval or semi-oval cross-section has its distal end removably inserted into the second socket.

A first horizontal bar has a distal end and a proximal end and defines a length between its distal end and proximal end. The proximal end of the first flexible pole is removably attachable to the first horizontal bar at a location along the length of the first horizontal bar that is not its distal end or its proximal end. The first horizontal bar may have a neck extending from its bottom surface, and that neck defines a slot to engage a portion of the proximal end of the first flexible pole. A first knob projects from a surface of the first horizontal bar for securing a portion of the net to the first horizontal bar. The first knob may project from the front face of the first horizontal bar.

A second horizontal bar has a distal end and a proximal end and defines a length between its distal end and proximal end. The proximal end of the second flexible pole is removably attachable to the second horizontal bar at a location along the length of the second horizontal bar that is not its distal end or its proximal end. The second horizontal bar may have a neck extending from its bottom surface, and that neck defines a slot to engage a portion of the proximal end of the second flexible pole. A second knob projects from a surface of the second horizontal bar for securing a portion of the net to the second horizontal bar. The second knob may project from the front face of the second horizontal bar. A wire or cord may extend between the distal end of the first horizontal bar and the distal end of the second horizontal bar.

A net that has a top front edge and side front edges is engaged to the first horizontal bar and the second horizontal bar so as to be held in tension along its top front edge and draped from the first horizontal bar and the second horizontal bar to the base. When the net is so engaged to the first horizontal bar and the second horizontal bar, the net defines a net depth, without any other vertically extending net supports beyond the first flexible pole and the second flexible pole. Fasteners may join the net to the base. A reinforcement tap may extend along the top front edge and side front edges of the net. Loops may be provided to join (a) a bottom of one of the side front edges to an end of the left side section of the base, and (b) a bottom of one of the side front edges to an end of the right side section of the base.

One or more sleeves may be joined or appended to the net that are adapted for receiving the first flexible pole. One or more sleeves may be joined or appended to the net that are adapted for receiving the second flexible pole.

Hand grips may be disposed around the circumferences of each of the first flexible pole and second flexible pole.

A more complete understanding of various configurations of the portable sports practice net, and the portable soccer goal frame and portable soccer goal disclosed herein will be afforded to those skilled in the art, as well as a realization of additional advantages and objects thereof, by consideration of the following detailed description. Reference will be made to the appended sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION

Figure 1:
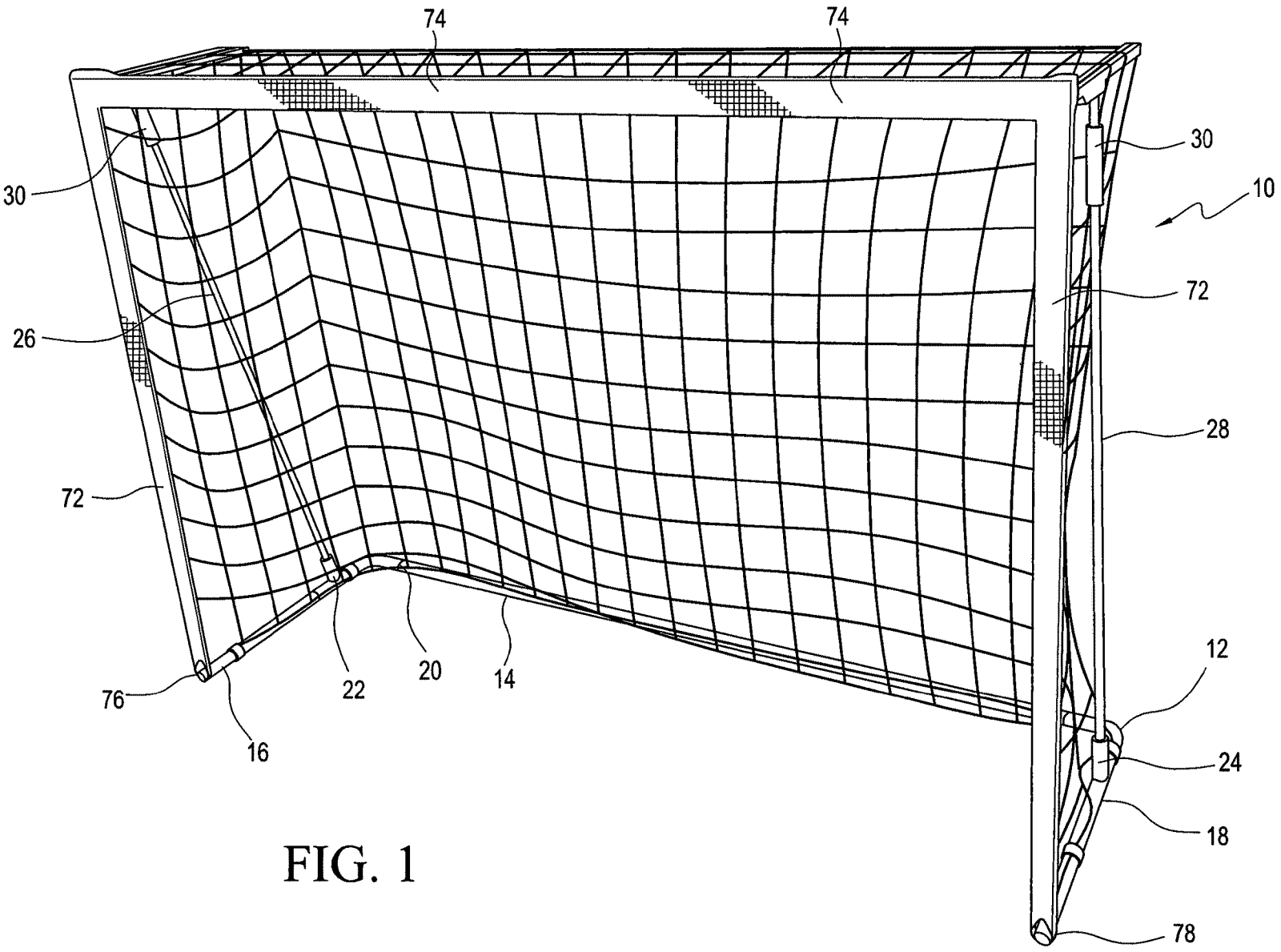
FIG. 1 is a right front perspective view of a portable sports goal according to one embodiment of the invention.

Certain terminology is used in the following description for convenience only and is not limiting. The words "lower," "bottom," "upper," "top," "right" and "left" designate directions in the drawings to which reference is made. The words "inwardly," "outwardly," "upwardly" and "downwardly" refer to directions toward and away from, respectively, the geometric center of the headrest, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

As used herein the term "goal" is broadly construed to include any frame or other structure to which is attached or from which is suspended a net or fabric to create a target space or pocket into which a ball or puck is directed. As used herein the term "sports practice net" is broadly construed to include any frame or other structure to which is attached or from which is suspended a net or fabric to create a target space toward which and/or into which a ball or puck is directed.

Turning in detail to the drawings, FIGS. 1-4 show a portable soccer goal 100 having a net 70 connected to a frame structure to support the net. The frame has a base 12 with a center bar or channel 14 and a left side bar or channel 16 and a right side bar or channel 18. The left side bar 16 is disposed at an angle from the center bar or channel 14 in the range of about 90 to 120 degrees. The right side bar 18 is disposed at an angle from the center bar or channel 14 in the range of about 90 to 120 degrees. Preferably, the left side bar 16 and right side bar 18 are slidably removably joined to the center bar 14 such as with spring button release fasteners 20. Alternatively, the center bar 14 is separable into two or more pieces that are slidably removably joined together. Or, as still another alternative, the center bar 14 and left side bar 16 and right side bar 18 are of one integral piece. The base 12 can also be made using a folding metal base with locking buttons. The base 12 may be formed of an extruded metal tube or channel that is powder coated for improved weather resistance.

A first socket 22 is welded to the top surface of the left side bar 16. A second socket 24 is welded to the top surface of the right side bar 18. The first socket 22 and second socket 24 define circular openings or hollows to receive distal ends of vertical poles 26, 28. As an alternative to welding, the sockets 22, 24 may be adhesively joined, or the sockets 22, 24 may be integrally formed into the left side bar 16 and right side bar 18. In a preferred embodiment, the first socket 22 and second socket 24 are disposed at an angle from vertical and directed with their openings away from the center bar 14. In the embodiment shown in FIGS. 1 and 2, the first socket 22 and second socket 24 are disposed at an angle in the range of 60 to 85 degrees from horizontal (e.g. from 0), or 5 to 30 degrees from vertical. The angle may be adjusted depending upon the size of the soccer goal (height and pocket).

A first pole 26 has a distal end (or bottom end) and a proximal end (or top end) and is removably joined to the base 12 by inserting its distal end into the socket 22. A second pole 28 has a distal end (or bottom end) and a proximal end (or top end) and is removably joined to the base 12 by inserting its distal end into the socket 24. The first pole 26 and second pole 28 are flexible, and preferably are formed of fiberglass. Handgrips 30 may be installed around the circumference of each of the first pole 26 and second pole 28 for ease in handling when assembling the frame. Handgrips 30 may be formed of polyurethane foam or of molded rubber or like resilient materials.

Figure 2:
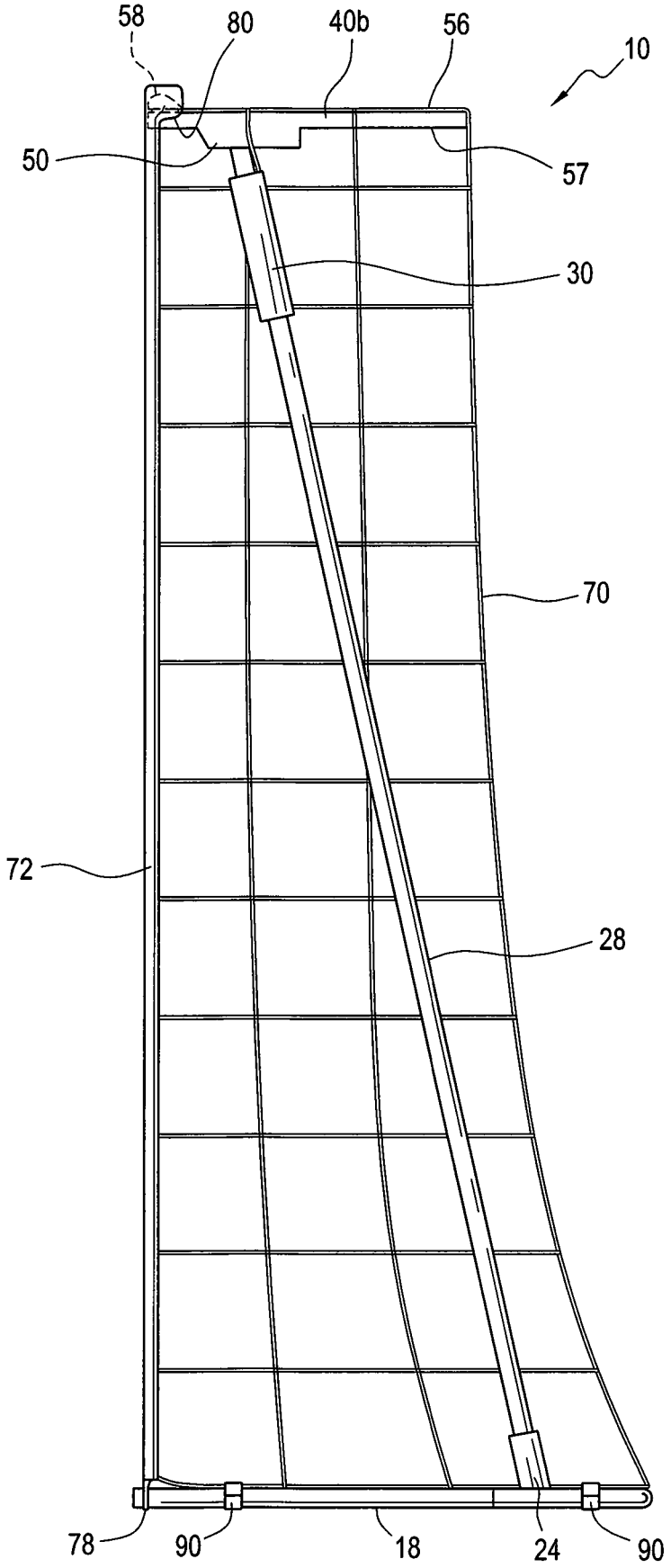
FIG. 2 is a right side elevational view of the portable sports goal of FIG. 1.
Figure 3:
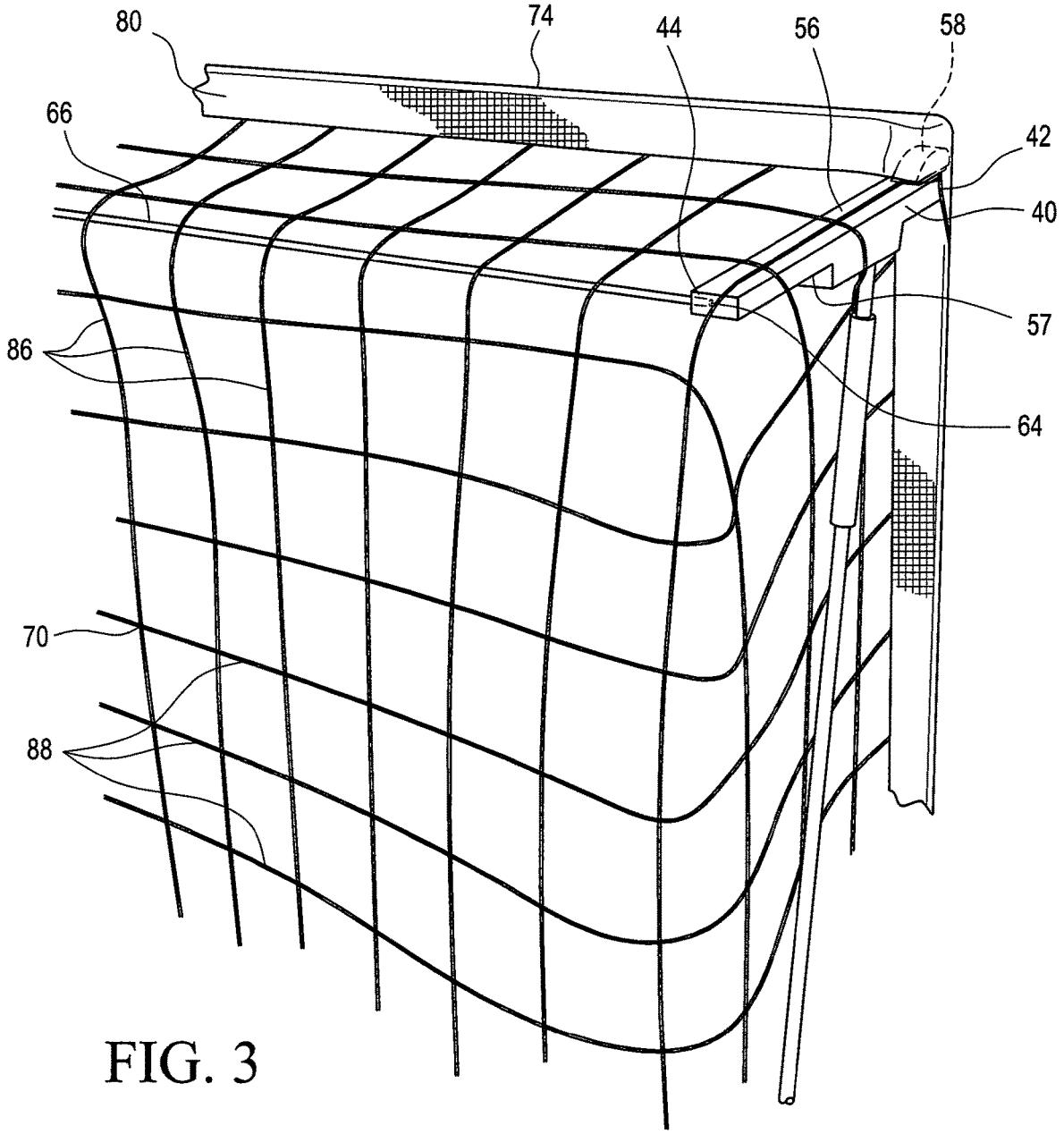
FIG. 3 is a partial left rear perspective view of the portable sports goal of FIG. 1.
Figure 4:
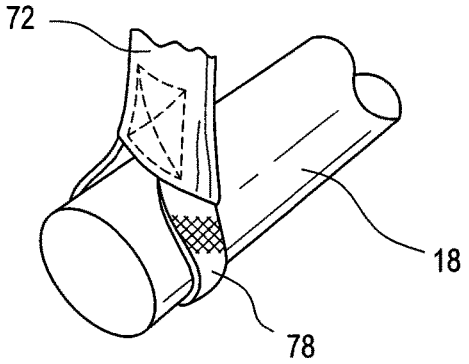
FIG. 4 is a right front perspective view of a right side base member showing joining of a net to the base member.
Figure 5:
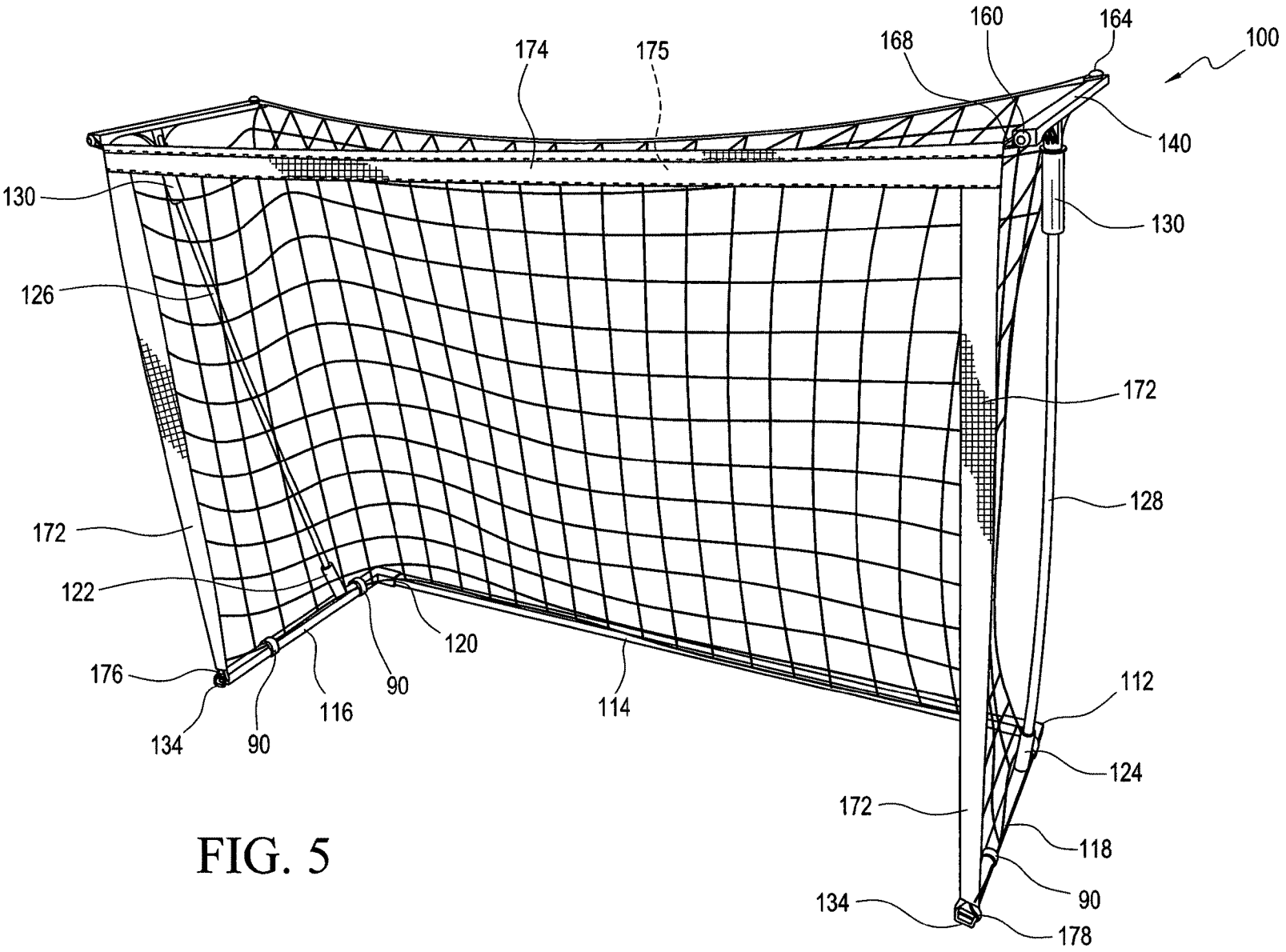
FIG. 5 is a right front perspective view of a second embodiment of a portable sports goal according to a second embodiment of the invention.
Figure 6:
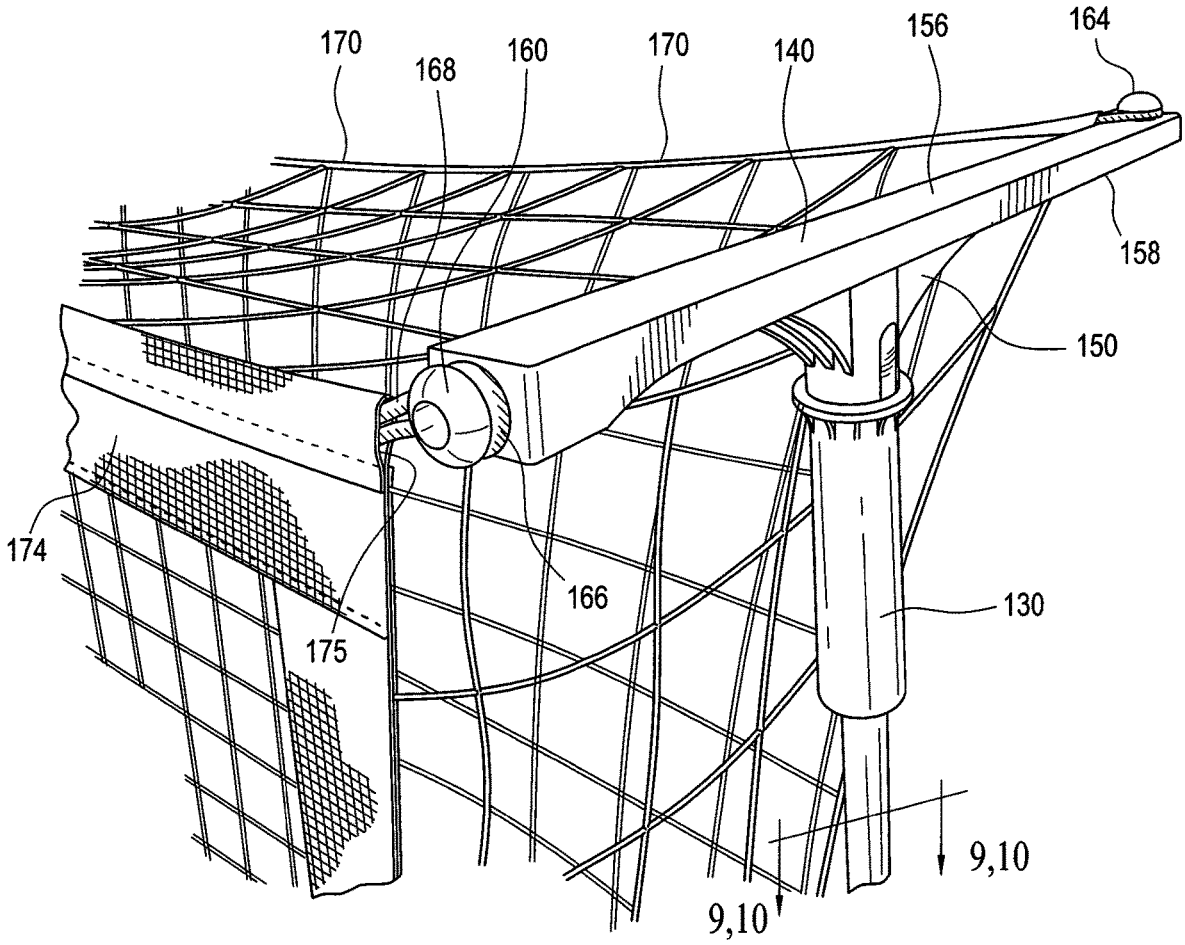
FIG. 6 is a partial left rear perspective view of the portable sports goal of FIG. 5.
Figure 7:
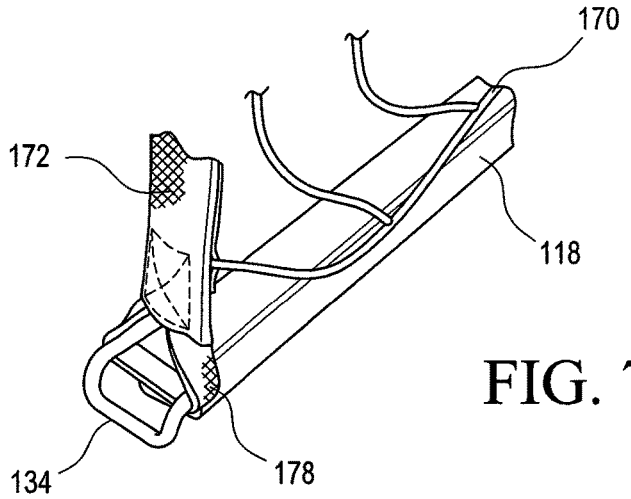
FIG. 7 is a right front perspective view of a right side base member showing joining of a net to the base member.
Figure 8:
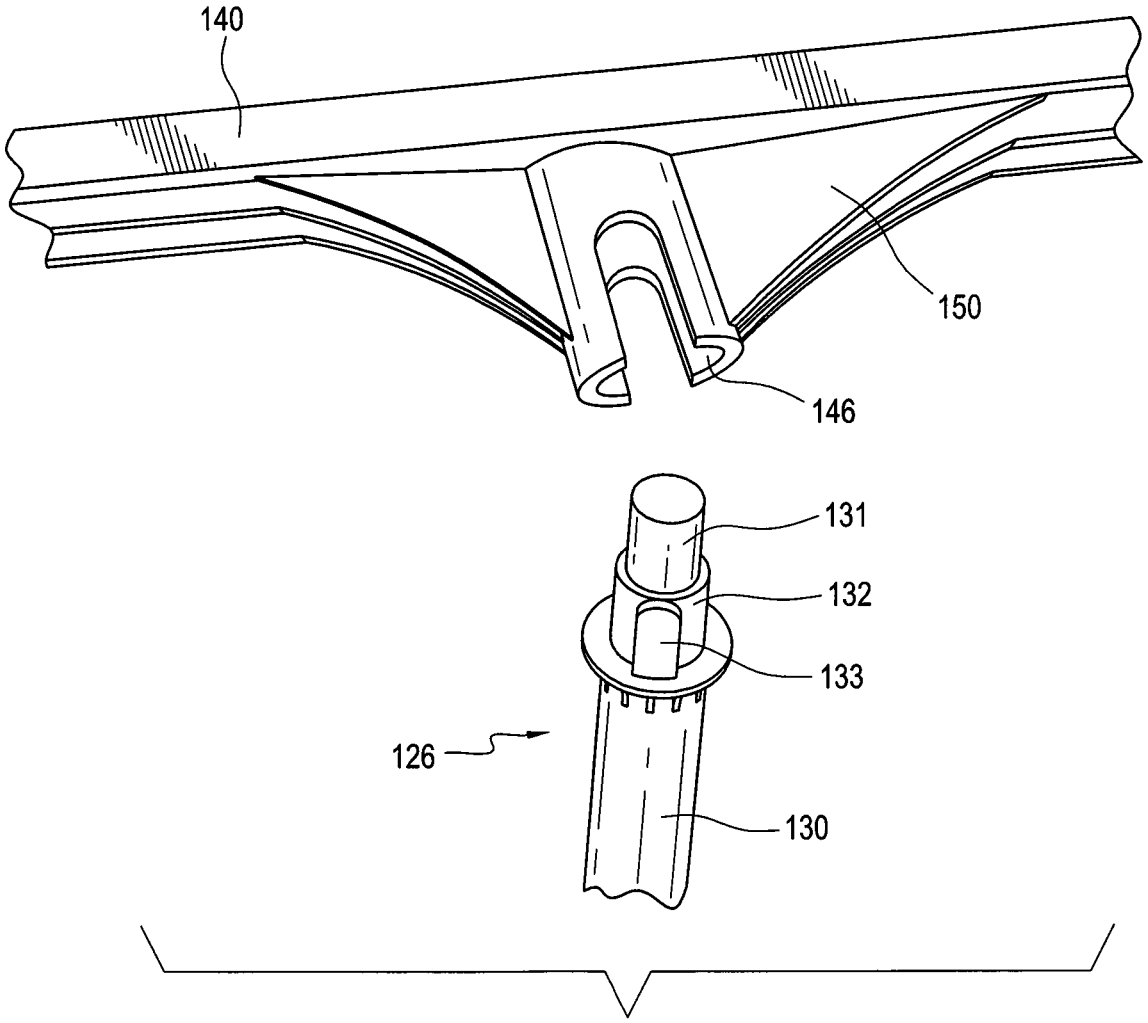
FIG. 8 is an exploded view of a horizontal bar of the embodiment of FIG. 5 and a top portion of the flexible post onto which the horizontal bar is attached; [0025]1

In the embodiment shown in FIGS. 1-3, the first pole 26 and second pole 28 have generally circular cross-sections. Alternatives to this include poles with oval or semi-oval cross-sections.

At the proximal end (or top end) of the first pole 26 a first horizontal bar 40 is mounted. The first horizontal bar 40 has a proximal end (or front end) and a distal end (or rear end), and has a top surface 56 and a bottom surface 57. The first horizontal bar 40 has reinforcing material or a step 50 extending downwardly from its bottom surface at or near the proximal end of the first horizontal bar 40. The step 50 defines a receiving hole or recess adapted to receive the proximal end (or top end) of the first pole 26. In this embodiment, the receiving hole or recess is not centrally located along the length of the first horizontal bar 40, but is eccentrically located closer to the proximal end than to the distal end of the first horizontal bar 40. The first horizontal bar 40 has an upraised knob 58 extending up from the top surface 56 at or near the proximal end of the first horizontal bar. The knob 58 has a convexly curved upper knob surface. The first horizontal bar 40 additionally defines a net attachment point 64 at or near its distal end. The first horizontal bar 40 optionally is wider 54 at its proximal or front end that at its distal or rear end.

A second horizontal bar 40*b* has a structure comparable to the first horizontal bar 40. The second horizontal bar 40*b* is adapted to receive the proximal end (or top end) of the second pole 28.

A wire or cord 66 connects the first horizontal bar 40 to the second horizontal bar 40*b*. The wire or cord 66 extends from the distal end of the first horizontal bar 40 to the distal end of the second horizontal bar 40*b*. Preferably, the wire or cord has a length equal to or shorter than the length of the center bar 14. The length of the wire or cord preferably is proportionate to the size of the soccer goal. For a six-foot (1.8 m) wide soccer goal, the length of the wire or cord would be approximately 6 feet (1.8 m), plus some added length for the attachment loops on the ends. For a twenty-four-foot (7.3 m) wide soccer goal, the length of the wire or cord would be approximately 24 feet (7.3 m) plus some added length for the attachment loops on the ends.

Referring still to FIGS. 1-4, the portable soccer goal 10 of the first embodiment of the invention is shown with the net 70 attached to the frame. The net 70 comprises a woven material having vertical strands 86 crossing horizontal strands 88. The net 70 further includes a reinforcement tape 74 at the front top horizontal center edge and reinforcement tapes 72 at the front side vertical edges. The reinforcement tapes 72, 74 together define the mouth of the goal. Loops 78 at the bottom edges of the front side reinforcement tapes 72 are secured around the front ends of the right side 16 and left side 18 of the base 12 (see FIGS. 1 and 4). The front ends of the right side 16 and left side 18 of the base 12 may have extensions or other fastening means to receive the loops 78.

A pocket 80 is formed by or in the reinforcement tape 74 at the front top horizontal center edge. The knobs 58 extending from the top surfaces of the horizontal bars 40, 40*b* fit within the pocket 80 to hold the top portion of the net above a ground or floor surface. The flexible poles 26, 28 at their distal ends form pivot points. The flexible poles 26, 28 urge the horizontal bars 40, 40*b* apart to impart tension into the top horizontal center edge of the net 70, thus reducing sag at the top edge of the goal opening.

Hook and loop fasteners (e.g., Velcro) 90 are looped through bottom edges of the net 70 and around the base 12 to join the bottom of the net to the base.

Referring next to FIGS. 5-10, a portable soccer goal 100 of another embodiment of the invention has a net 170 connected to a frame structure to support the net. The frame has a base 112 with a center bar or channel 114 and a left side bar or channel 116 and a right side bar or channel 118. The left side bar 116 is disposed at an angle from the center bar or channel 114 in the range of about 90 to 120 degrees. The right side bar 118 is disposed at an angle from the center bar or channel 114 in the range of about 90 to 120 degrees. Preferably, the left side bar 116 and right side bar 118 are slidably removably joined to the center bar 114 such as with spring button release fasteners 120. Alternatively, the center bar 114 is separable into two or more pieces that are slidably removably joined together. Or, as still another alternative, the center bar 114 and left side bar 116 and right side bar 118 are of one integral piece. The base 112 may be formed of an extruded metal tube or channel that is powder coated for improved weather resistance.

In the embodiment shown (see FIGS. 5 and 7), a buckle footing 134 extends outwardly from the proximal ends of each of the left side bar 116 and right side bar 118 of the frame. The buckle footings 134 define openings through which stakes (not shown) may be inserted for joining the frame to a ground surface.

A first socket 122 is welded to the top surface of the left side bar 116. A second socket 124 is welded to the top surface of the right side bar 118. The first socket 122 and second socket 124 define openings or hollows to receive distal ends of vertical poles 126, 128. As an alternative to welding, the sockets 122, 124 may be adhesively joined, or the sockets 122, 124 may be integrally formed into the left side bar 116 and right side bar 118. In a preferred embodiment, the first socket 122 and second socket 124 are disposed at an angle from vertical and directed with their openings away from the center bar 114. In the embodiment shown in FIG. 5, the first socket 122 and second socket 124 are disposed at an angle in the range of about 5 to 30 degrees from vertical.

A first pole 126 has a distal end (or bottom end) and a proximal end (or top end) and is removably joined to the base 112 by inserting its distal end into the socket 122. A second pole 128 has a distal end (or bottom end) and a proximal end (or top end) and is removably joined to the base 112 by inserting its distal end into the socket 124. The first pole 126 and second pole 128 are flexible, and preferably are formed of fiberglass. Handgrips 130 may be installed around the circumference of each of the first pole 126 and second pole 28 for ease in handling when assembling the frame. Handgrips 130 may be formed of polyurethane foam or of molded rubber or like resilient materials. For a larger soccer goal, more fiberglass poles may be required to support the net. For example, for a goal that is eight-feet (2.4 m) tall, three poles generally will be required.

Figure 9:
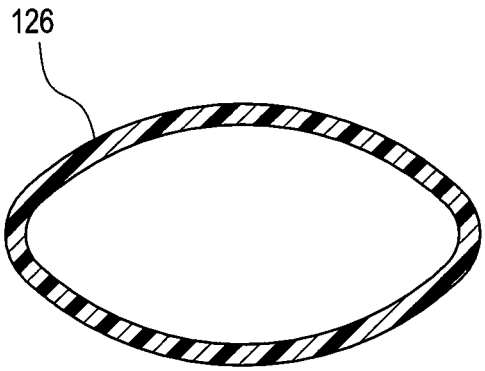
FIG. 9 is a cross-sectional view taken along line 9-9 of FIG. 6 of a first configuration for a cross-section of the flexible post.
Figure 10:
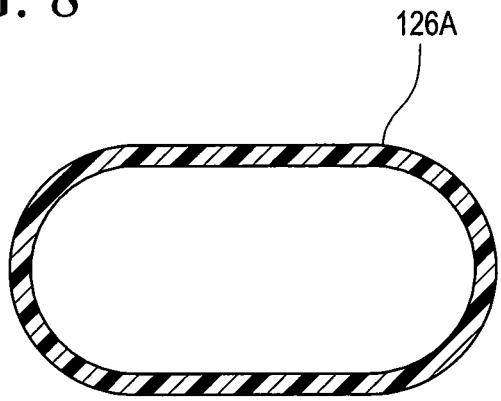
FIG. 10 is a cross-sectional view taken along line 10-10 of FIG. 6 of a second configuration for a cross-section of the flexible post and FIG. 11 is a left front perspective view of a portable sports practice net according to a third embodiment of the invention.

In the embodiment shown in FIGS. 5-10, the first pole 126 and second pole 128 have generally oval 126A or semi-oval 126 cross-sections (see FIGS. 9 and 10). Alternatives to this include poles with round or other geometric cross-sections. The first pole and second pole 126, 128 are generally hollow poles causing the poles to flex or bend along their length.

At the proximal end (or top end) of the first pole 126 a first horizontal bar 140 is mounted. The first horizontal bar 140 has a proximal end (or front end) 142 and a distal end (or rear end) 144, and has a top surface 156 and a bottom surface 157. The first horizontal bar 140 has a downwardly depending neck 148 reinforced by shoulder flanges 150. The neck 148 defines a slot or hole 148 adapted to receive a top end portion 131 of either the first pole 126 or the second pole 128. See FIG. 8. In the embodiment shown, the slot or hole 146 is located centrally or approximately centrally between the proximal end and distal end of the first horizontal bar 140. The slot or hole 146 of the horizontal bar 140 receives the top end portion 131 of the pole 126, as well as the raised sleeve 132 and raised key section 133 of the pole 126 to secure the horizontal bar 140 against rotation on the pole 126.

The first horizontal bar 140 has an upraised knob 164 extending up from the top surface 156 at or near the distal end of the first horizontal bar 126. The knob 164 has a convexly curved upper knob surface. The first horizontal bar 140 further has an outwardly projecting knob 160 extending from its proximal end 142. See FIG. 6.

A second horizontal bar 140 has a structure comparable to the first horizontal bar 140. The second horizontal bar 140 is adapted to receive the proximal end (or top end) of the second pole 128.

A wire or cord 168 connects the proximal end of the first horizontal bar 140 to the proximal end of the second horizontal bar 140. The wire or cord 168 is looped 166 around the knob 160 projecting from the first horizontal bar, and is looped around the knob 160 extending from the second horizontal bar. Preferably, the wire or cord has a length equal to or shorter than the length of the center bar 114. The length of the wire or cord 168 generally matches the length of the mouth of the soccer goal. A six-foot (1.8 m) wide goal will have a wire or cord with a length of 6 feet (1.8 m), plus some added length for the loops at the ends. The wire or cord 168 optionally may be elastic and have a stretch tension along its length.

Referring still to FIGS. 5-10, the portable soccer goal 100 of the second embodiment of the invention is shown with the net 170 attached to the frame. The net 170 includes a reinforcement tape 174 at the front top horizontal center edge and reinforcement tapes 172 at the front side vertical edges. The reinforcement tapes 172, 174 together define the mouth of the goal. Loops 176, 178 at the bottom edges of the front side reinforcement tapes 172 are secured around the front ends of the right side 116 and left side 118 of the base 112 (see FIG. 7). Preferably, the loops 176, 178 are extended around the bottom edges at locations spaced apart from the buckle footings 134, and the buckle footings serve a secondary function to maintain the loops 176, 178 on the base 112. Alternatively, the front ends of the right side 116 and left side 118 of the base 112 may have extensions or other fastening means to receive the loops 176, 178.

Loops 180 182 extending from horizontal strands located at what will be the back corners of the net 170 are connected around the knobs 164 on the horizontal bars 140 to hold the top portion of the net 170 above a ground or floor surface by the poles 126, 128.

A pocket 175 is formed by or in the reinforcement tape 174 at the front top horizontal center edge. The wire or cord 168 is threaded through the pocket 175 to hold the top portion of the net 170 above a ground or floor surface. The combination of horizontal bars 140 and poles 126, 128 create the goal opening or pocket. The flexible poles 126, 128 at their distal ends form pivot points. The flexible poles 126, 128 urge the horizontal bars 140 apart to impart tension into the top horizontal center edge of the net 170, thus reducing sag at the top edge of the goal opening.

Alternatively, grommets or reinforced holes (not shown) may be provided in the reinforcement tape 174 that may be mated with the knobs 160 projecting from the horizontal bars 140.

Hook and loop fasteners (e.g., Velcro) 90 are looped through bottom edges of the net 170 and around the base 112 to join the bottom of the net to the base. Metal or plastic fasteners also may be used to attach the edges of the net to the metal frame.

As stated above, within the current group of portable goals available in the prior art, several problems exist. The first problem is the sagging of the top cross bar which is made of fabric suspended by vertical posts over the top center of the goal. The second problem is the difficulty of set up. The portable soccer goal and net design according to the invention allows for easy roll up of the net and unpackaging when setting up. The third benefit is that prior art portable nets do not replicate a real soccer goal as they do not form a proper "pocket" for the goal opening without adding extra vertical posts. The fourth benefit is the stability of the net according to the invention. More weight is placed forward and will thus allow harder kicks from the soccer goal without the frame or net toppling over. [(0056] The net according to the invention utilizes a horizontal bar that attaches to the top of the fiberglass support pole. The net is attached to the horizontal bar so when it is placed on the frame the net is suspended over the top of the net instead of hanging directly from the front top fabric. Because the horizontal bars create a lever action the net hanging between the bars is pulled tighter than is possible using similar diameter fiberglass poles without the horizontal bars. The horizontal cross bars incorporate an elevated "bump" across the front of the net supporting the fabric stretched between them, eliminating the weight of the netting hanging directly from the top cross bar of the mouth of the net.

The claimed invention differs from what currently exists. This net incorporates two horizontal bars, one placed on top of each of the fiberglass posts on either side of the net. The horizontal bar holds the net in a unique configuration that supports the net into a larger pocket and with more tension across the front top of the net than is possible with a similar net supported only by fiberglass poles. The horizontal supports extend the net back, up, and away from the front of the net.

The claimed invention is an improvement on what currently exists. This net incorporates two horizontal bars, one placed on top of the fiberglass post on either side of the net. The horizontal bar holds the net in a unique configuration that supports the net into a larger pocket and with more tension across the front top of the net than is possible with a prior art net supported only by fiberglass poles. The horizontal supports extend the net back away from the front of the net. Across a large span fabric will sag even when under tension between two posts. When making a net with a pocket, all prior art nets require an extra vertical post or extra vertical posts supports to hold the rear of the net up.

The unique shape of the top horizontal supports reduces weight placed on the fabric hung between the supporting posts. The top support also creates the pocket without the use of extra vertical support posts. The single fiberglass post creates a pivot point that then creates leverage between the opposite top support bars so that the weight of the hanging net tightens the top fabric at the mouth of the net.

The inventive portable soccer goal includes:

1. Metal base made of break-apart or foldable metal tubes. The base has two attachment points for the vertical fiberglass poles to be removably attached.

2. Two vertical fiberglass posts. Each post has a handle to make it easier to attach the top bar to the top of the post. The posts can be disassembled for storage.

3. Two plastic bars, where one of which attaches to the top of the first fiberglass pole, and the other of which attaches to the top of the second fiberglass pole. The bars are attached at the rear of the net by a wire/rope. The plastic bars also have an attachment point that keeps the rear of the net in place. Preferably, the plastic bars are molded of a thermoplastic resin or of a high impact polycarbonate resin.

4. Net that is hung between the top horizontal plastic bars, hung over the rope between the rear of the two horizontal bars and down to the metal base on three sides.

5. Carrying bag to transport the portable soccer goal product when it is disassembled.

6. Velcro hook and loop fastener strips (or alternatively metal or plastic fasteners) to join the bottom of the net to the metal base at the center and on the sides of the metal base.

The components have the following relationship:

1. The foldable base is set up in the location that the net will be used.

2. The fiberglass poles are placed into the attachment points on the base frame.

3. Optionally, the net is stored rolled around the top horizontal bars.

The net is unrolled between the two fiberglass poles. A horizontal bar is placed onto the top of each fiberglass pole suspending the net tightly between each fiberglass pole. The net is secured to the metal base using hooks or Velcro fasteners.

How the Invention Works:

The metal base creates the weight and support for the fiberglass poles. The fiberglass poles, once placed into the attachment points of the metal base, create the tension and support that hold the horizontal bars both up and push them outwards to create tension that supports the net. The horizontal cross bars pivot on the top of the fiberglass poles. When the net is hung between the horizontal bars, it pulls on both the front and rear of the horizontal bars. As tension is placed on the rope that joins the rear of the horizontal bar it puts more tension on the front of the net reducing sag at the top of the mouth of the net. The raised front on the top horizontal bar supports the center fabric stretched between the fabric that forms the top of the mouth of the net reducing sag.

How to Make the Invention:

The product is manufactured using metal tubing, formed using dies and welded pieces to hold the fiberglass poles. The metal is power-coated for outdoor use. The fiberglass poles are extruded, cut, and painted. The top cross bars are formed using injection molded plastic. The netting is woven, cut and sewn together. The bag is made from sewn fabric.

The top horizontal cross bars are essential to the purpose of the invention. The frame materials could be changed and the fiberglass poles could be changed. The netting is critical in order to stop the ball and to function as a traditional soccer goal.

If an extra fiberglass pole was added to provide more support to the horizontal bar, the net would still function in the same manner. The position and angles of the fiberglass support poles could be changed and the net would still function in the same way.

How to Use the Invention:

A soccer player would use this net on fields, in gyms or in backyards where large soccer goals are impractical due to their size and weight, or where more goals are needed for a short period of time to increase the ability for more players to practice. The goal allows for practicing anywhere a soccer goal is not present or where more goals are needed.

Additionally, this product could be used to create support for shade or protection from the sun or rain if the net material was replaced by a fabric or water proof fabric stretched between the two top horizontal bars. Beyond soccer, the net could also be used for other sports where the ball needs to be stopped. Such other sports could be, but are not limited to, golf, lacrosse, baseball, hockey and football.

Thus, various configurations of goal frames and portable soccer goal frames with top side bar supports are disclosed.

Figure 11:
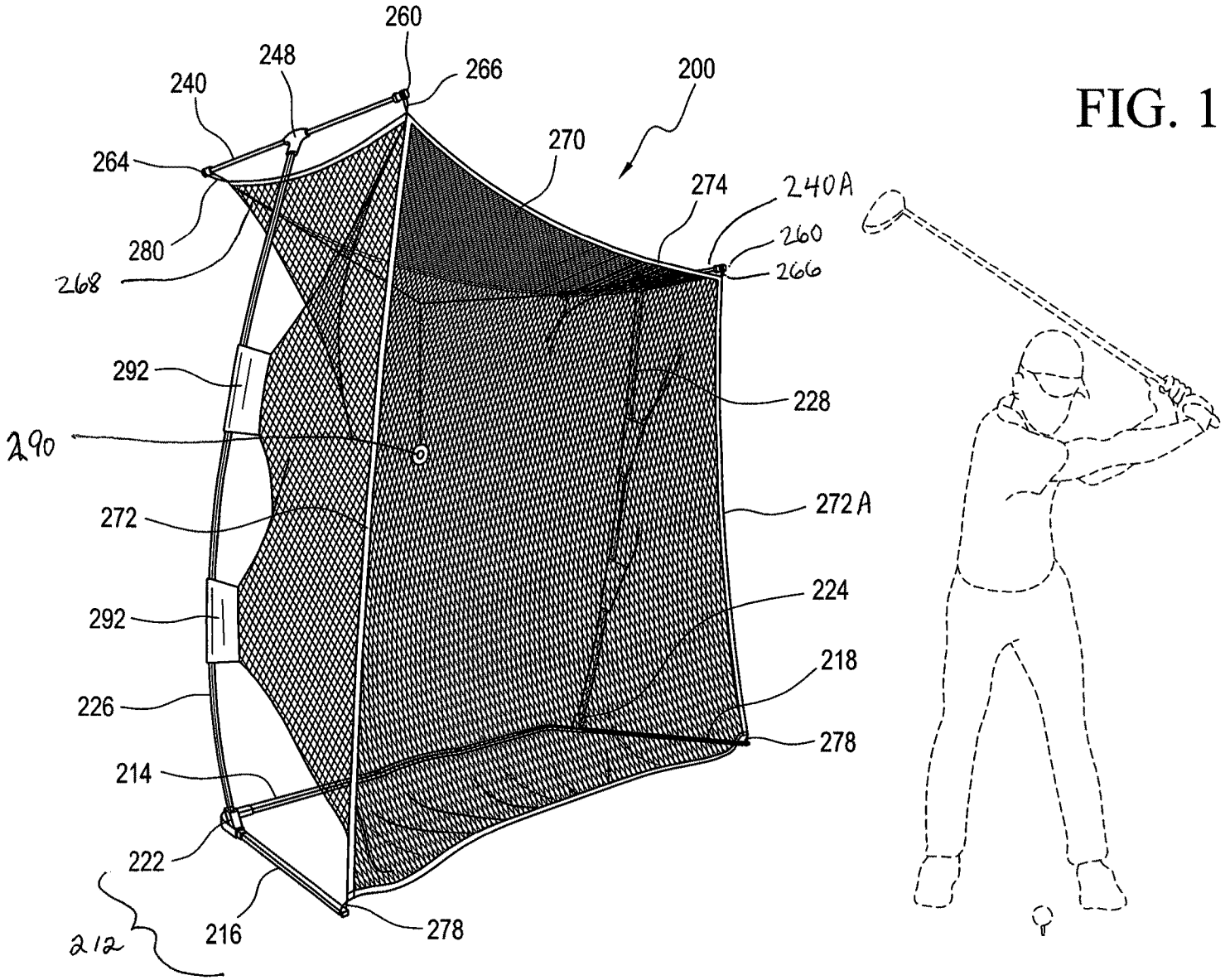

Referring next to FIG. 11, a sports practice net 200 is configured as a golf training net. The sports practice net 200 has a base 212 with a center section 214, a left side section 216 and a right side section 218. The left side section 216 and the left side of the center section 214 are removably joined to a first corner socket. The right side section 218 and the right side of the center section 214 are removably joined to a second corner socket.

A first vertical socket 222 extends upwardly from the first corner socket. The first vertical socket 222 is angled away from the top surface of the first corner socket. A second vertical socket 224 extends upwardly from the second corner socket. The second vertical socket 224 is angled away from the top surface of the second corner socket. In the embodiment shown in FIG. 11, the first vertical socket 222 and second vertical socket 224 are disposed at an angle in the range of 60 to 85 degrees from horizontal (e.g. from 0), or 5 to 30 degrees from vertical. The angle may be adjusted depending upon the size of the sports practice net (height and pocket depth).

For the sports practice net of FIG. 11, a first pole 226 has a distal end (or bottom end) and a proximal end (or top end) and is removably joined to the base 212 by inserting its distal end into the first vertical socket 222. A second pole 228 has a distal end (or bottom end) and a proximal end (or top end) and is removably joined to the base 212 by inserting its distal end into the second vertical socket 224. The first pole 226 and second pole 228 are flexible, and preferably are formed of fiberglass. Handgrips (not shown in FIG. 11) may be installed around the circumference of each of the first pole 226 and second pole 228 for ease in handling when assembling the frame. Handgrips may be formed of polyurethane foam or of molded rubber or like resilient materials.

In the embodiment shown in FIG. 11, the first pole 226 and second pole 228 have semi-oval cross-sections. Alternatives to this include poles with circular or oval cross-sections. The first pole and second pole 226, 228 are generally hollow poles causing the poles to flex or bend along their length. The poles 226, 228 may be formed of two or more pole segments that are joined together with fasteners, such as but not limited to threaded fasteners.

At the proximal end (or top end) of the first pole 226 a first horizontal bar 240 is mounted. The first horizontal bar 240 has a proximal end (or front end) and a distal end (or rear end), and has a top surface and a bottom surface.

The first horizontal bar 240 is movably engaged to a downwardly depending neck 248. The neck 248 defines a slot or hole 246 adapted to receive a top end portion of the first pole 226. See FIG. 11. In the embodiment shown, the slot or hole 246 is located centrally or approximately centrally between the proximal end and distal end of the first horizontal bar 240. The slot or hole 246 of the horizontal bar 240 receives the top end portion of the first vertical pole 226.

The first horizontal bar 240 has shaped projections or knobs 260 and 264 extending outwardly from the front end and from the rear end of the first horizontal bar 240. The knobs 260, 264 each have a convexly curved upper knob surface.

A second horizontal bar 240A has a structure comparable to the first horizontal bar 240. The second horizontal bar 240A has a depending neck that 248 is adapted to receive the proximal end (or top end) of the second pole 228.

A wire or cord 268 connects the rear end of the first horizontal bar 240 to the rear end of the second horizontal bar 240. The wire or cord 268 is looped 280 around the knob 264 projecting from the first horizontal bar, and is looped around the knob 264A extending from the second horizontal bar 240A. Preferably, the wire or cord 268 has a length equal to or shorter than the length of the center base bar 214. The length of the wire or cord 268 generally matches the length of the mouth of the sports practice net. A six-foot (1.8 m) wide net opening will have a wire or cord with a length of 6 feet (1.8 m), plus some added length for the loops at the ends. The wire or cord 268 optionally may be elastic and have a stretch tension along its length.

The sports practice net 200 is shown with a net 270 attached to the frame. The net 270 includes a reinforcement tape 274 at the front top horizontal center edge and reinforcement tapes 272, 272A at the front side vertical edges. The reinforcement tapes 272, 272A, 274 together define the mouth of the net opening. Loops 266 at the top edges of the reinforcement tapes 272, 272A are extended around knobs 260 at the front ends of the horizontal bars 240, 240A to join the reinforcement tapes 274, 272, 272A to the horizontal bars 240, 240A that are joined to the top of vertical poles/flexible posts 226, 228. Optionally, grommets may be used rather than loops 266.

Loops 276, 278 at the bottom edges of the front side reinforcement tapes 272, 272A are secured around the front ends of the right side 216 and left side 218 of the base 212. Preferably, the loops 276, 278 are extended around the bottom edges at locations spaced apart from the buckle footings, and the buckle footings serve a secondary function to maintain the loops 276, 278 on the base 212. Alternatively, the front ends of the right side 216 and left side 218 of the base 212 may have extensions or other fastening means to receive the loops 276, 278.

Sleeves 292 defining openings therein are appended to the net 270. Each vertical pole/flexible post 226 is threaded through one or more of such sleeves 292 to join the net 270 to the respective pole 226. The sleeves 282 may be reinforced nylon fabric or other weather-resistant coated fabric or may be stretch fabric. The sleeves 292 are pulled by the vertical poles 226 to impart tension to the net 270. Such tension causes the net 270 to rebound, absorbing the force of a golf ball that strikes the net face. Such tension also influences return to the golfer of each golf ball that strikes the net face. Moreover, the sleeves 292 prevent the vertical poles 226 from swinging outwardly unexpectedly towards a user assembling the sports practice net 200.

Loops 280, 282 in the wire or cord 268 are connected around the knobs 264, 264A on the horizontal bars 240, 240A to hold the top portion of the net 270 above a ground or floor surface by the poles 226, 228. Alternatively, the loops 280, 282 may extend from horizontal strands of the net located at what will be the back corners of the net 270.

The combination of horizontal bars 240, 240A and poles 226, 228 with sleeves 292 support the net 270 to create a net opening framed by the reinforcement tapes 272, 272A, 274. The flexible poles 226, 228 at their distal ends form pivot points. The flexible poles 226, 228 urge the horizontal bars 240 apart to impart tension into the top horizontal center edge of the net 270, thus reducing sag at the top edge of the net opening. The flexible poles 226, 228 urge the sleeves 292 around one pole 226 away from the sleeves 292 around the opposite pole 228 to impart tension to the back of the net 270, which gives the net a bounce back feature to absorb motion of the golf ball and return the golf ball to the practice golfer.

A target 290 may be appended to the wire or cord 268 to create a target to which a golfer may aim a shot. The target 290 may be weighted to add tension to the net 270 suspended from the horizontal bars 240, 240A and poles 226, 228. The target 290 may be formed of a fabric, such as nylon or felt, or may be molded thermoplastic or metal or a combination thereof, and has a weight of from about 0.1 lb to 3 lb. The target 290 may be suspended from a separate wire or cord that is attached to the wire or cord 268 (as shown in FIG. 11), or the target 290 may be directly joined to the wire or cord 268.

While embodiments of this invention have been shown and described, it will be apparent to those skilled in the art that many more modifications are possible without departing from the inventive concepts herein. Moreover, the examples described herein are not to be construed as limiting. The invention, therefore, is not to be restricted except in the spirit of the following claims.

What is claimed is:

1. A portable sports practice net, comprising:

a base having a center section, a left side section disposed at an angle to the center section, and a right side section disposed at an angle to the center section;

a first socket extending upwardly from the left side section;

a second socket extending upwardly from the right side section;

a first flexible pole having a distal end and a proximal end, with the distal end adapted for removable insertion into the first socket;

a second flexible pole having a distal end and a proximal end, with the distal end adapted for removable insertion into the second socket;

a first horizontal bar having a distal end and a proximal end and defining a length between its distal end and proximal end, said first horizontal bar having a top surface and a bottom surface opposite the too surface, and having a front surface at the proximal end, with a first knob projecting from the to surface of the first horizontal bar for securing a portion of the net to the first horizontal bar, the proximal end of the first flexible pole removably attachable to the first horizontal bar at a location along the length of the first horizontal bar that is not its distal end or its proximal end, wherein the first horizontal bar is supported above a ground or other support surface solely by the first flexible pole;

a second horizontal bar having a distal end and a proximal end and defining a length between its distal end and proximal end, said second horizontal bar having a top surface and a bottom surface opposite the top surface and having a front surface at the proximal end of the second horizontal bar, with a second knob projecting from the to surface of the second horizontal bar for securing a portion of the net to the second horizontal bar, the proximal end of the second flexible pole removably attachable to the second horizontal bar at a location along the length of the second horizontal bar that is not its distal end or its proximal end wherein the second horizontal bar is supported above the ground or other support surface solely by the second flexible pole; and a net having a top front edge and side front edges, said net engagable to the first horizontal bar and the second horizontal bar so as to be held in tension along its top front edge and draped from the first horizontal bar and the second horizontal bar to the base, wherein the net when engaged to the first horizontal bar and the second horizontal bar defines a net depth, without any other vertically extending net supports beyond the first flexible pole and the second flexible pole.

2. The portable sports practice net of claim 1, wherein the first knob is at or near the proximal end of the first horizontal bar and the second knob is at or near the proximal end of the second horizontal bar.

3. The portable sports practice net of claim 1, further comprising one or more fasteners to join the net to the base.

4. The portable sports practice net of claim 1, further comprising a wire or cord extending between the distal end of the first horizontal bar and the distal end of the second horizontal bar.

5. The portable sports practice net of claim 1, further comprising a reinforcement tape extending along the top front edge and side front edges of the net.

6. The portable sports practice net of claim 1, further comprising a loop adapted for joining a bottom of one of the side front edges of the net to an end of the left side section of the base.

7. The portable sports practice net of claim 1, further comprising a loop adapted for joining a bottom of one of the side front edges of the net to an end of the right side section of the base.

8. The portable sports practice net of claim 1, further comprising at least one sleeve joined or appended to the net, said at least one sleeve adapted for receiving the first flexible pole.

9. The portable sports practice net of claim 8, further comprising at least one second sleeve joined or appended to the net, said at least one second sleeve adapted for receiving the second flexible pole.

10. The portable sports practice net of claim 1, further comprising at least one loop joined or appended to the net, said at least one loop adapted for removable connection with the distal end of the first horizontal bar or with a projection from the first horizontal bar at or near the distal end of the first horizontal bar.

11. The portable sports practice net of claim 9, further comprising at least one second loop joined or appended to the net, said at least one second loop adapted for removable connection with the distal end of the second horizontal bar or with a second projection from the second horizontal bar at or near the distal end of the second horizontal bar.

12. The portable sports practice net of claim 1, wherein the first flexible pole and second flexible pole are comprised of one or more sections of fiberglass.

13. The portable sports practice net of claim 1, wherein the first flexible pole and second flexible pole are hollow.

14. The portable sports practice net of claim 1, further comprising a first hand grip disposed around a circumference of the first flexible pole and a second hand grip disposed around a circumference of the second flexible pole.

15. The portable sports practice net of claim 1, wherein the first horizontal bar and the second horizontal bar are comprised of a material selected from the group consisting of: molded thermoplastic resin, polycarbonate resin, metal, wood, and combinations of such materials.

16. The portable sports practice net of claim 1, further comprising a third knob projecting from the front surface of the first horizontal bar for securing a portion of the net to the first horizontal bar, and a fourth knob projecting from the front surface of the second horizontal bar for securing a portion of the net to the second horizontal bar.

17. The portable sports practice net of claim 1, wherein the first horizontal bar has a neck extending from its bottom surface, said neck defining a slot to engage a portion of the proximal end of the first flexible pole, and wherein the second horizontal bar has a second neck extending from its bottom surface, said second neck defining a second slot to engage a portion of the proximal end of the second flexible pole.

18. A frame for a portable sports practice net or sports goal, comprising:

a base having a center section, a left side section disposed at an angle to the center section, and a right side section disposed at an angle to the center section;

a first socket extending upwardly from the left side section;

a second socket extending upwardly from the right side section;

a first flexible pole having a distal end and a proximal end, with the distal end adapted for removable insertion into the first socket;

a second flexible pole having a distal end and a proximal end, with the distal end adapted for removable insertion into the second socket;

a first horizontal bar adapted for removable attachment to the proximal end of the first flexible pole, the first horizontal bar having a distal end and a proximal end and defining a length between its distal end and proximal end, said first horizontal bar having a top surface and a bottom surface opposite the top surface, and having a front surface at the proximal end and a rear surface at the distal end, the proximal end of the first flexible pole removably attachable to the first horizontal bar at a location along the length of the first horizontal bar that is not its distal end or its proximal end, wherein the first horizontal bar is supported above a round or other support surface solely the first flexible pole;

a first knob projecting from either the top surface or the front surface at or near the proximal end of the first horizontal bar;

a second knob projecting from either the top surface or the front surface at or near the distal end of the first horizontal bar;

a second horizontal bar adapted for removable attachment to the proximal end of the second flexible pole, the second horizontal bar having a distal end and a proximal end and defining a length between its distal end and proximal end, said second horizontal bar having a top surface and a bottom surface opposite the to surface and a front surface at the proximal end and a rear surface at the distal end of the second horizontal bar, the proximal end of the second flexible pole removably attachable to the second horizontal bar at a location along the length of the second horizontal bar that is not its distal end or its proximal end, wherein the second horizontal bar is supported above the ground or other support surface solely by the second flexible pole;

a third knob projecting from either the top surface or the front surface at or near the proximal end of the second horizontal bar; and a fourth knob projecting from either the top surface of the front surface at or near the distal end of the second horizontal bar.

19. The frame of claim 18, further comprising a wire or cord extending between the first knob and the third knob.

20. The frame of claim 18, wherein the first flexible pole and second flexible pole are comprised of one or more sections of fiberglass.

21. The frame of claim 18, further comprising a first hand grip disposed around a circumference of the first flexible pole and a second hand grip disposed around a circumference of the second flexible pole.

22. The frame of claim 18, wherein the first horizontal bar has a neck extending from the bottom surface of the first horizontal bar, said neck defining a slot to engage a portion of the proximal end of the first flexible pole, and wherein the second horizontal bar has a second neck extending from the bottom surface of the second horizontal bar, said second neck defining a second slot to engage a portion of the proximal end of the second flexible pole.

* * * * *